US005628221A

United States Patent [19]

Pardi et al.

[11] Patent Number: 5,628,221

[45] Date of Patent: May 13, 1997

[54] FIN MILL MACHINE

[75] Inventors: Ronald L. Pardi, Canton; Alfred J. Michelini, Redford; Rodger A. Lisk, Dearborn, all of Mich.

[73] Assignee: Ford Motor Company, Dearborn, Mich.

[21] Appl. No.: 563,254

[22] Filed: Nov. 27, 1995

[51] Int. Cl.[6] ..... B21D 13/04

[52] U.S. Cl. ..... 72/187

[58] Field of Search ..... 72/8.6, 9.2, 186, 72/187, 196; 226/39; 242/419.4

[56] References Cited

U.S. PATENT DOCUMENTS

| | | | |
|---|---|---|---|
| 2,329,789 | 9/1943 | Schank et al. | 72/196 |
| 2,975,817 | 5/1961 | Neff . | |
| 3,367,161 | 2/1968 | Avakian . | |
| 4,033,492 | 7/1977 | Imai . | |
| 4,059,000 | 11/1977 | Bodnar . | |
| 4,753,096 | 6/1988 | Wallis . | |
| 4,953,378 | 9/1990 | Wallis . | |
| 5,022,161 | 6/1991 | Gray et al. . | |
| 5,207,083 | 5/1993 | Bongiovanni et al. . | |

FOREIGN PATENT DOCUMENTS

| | | |
|---|---|---|
| 57-168716 | 10/1982 | Japan . |
| 59-42135 | 3/1984 | Japan . |
| 59-42137 | 3/1984 | Japan . |
| 63-101028 | 5/1988 | Japan . |
| 3-243222 | 10/1991 | Japan . |

*Primary Examiner*—Lowell A. Larson
*Attorney, Agent, or Firm*—Donald A. Wilkinson

[57] ABSTRACT

A fin mill machine (12) for forming strip stock (14) into corrugated fins (16) to form heat exchanger fins or the like. The fin mill machine (12) includes a tension control subsystem (20) employing a pneumatic cylinder (32) to create the tension which is controlled by a feedback loop which automatically adjusts cylinder pressure based upon measurements from a strain gauge (44). The fin mill machine also includes a height measurement subsystem (22) which continually measures the average height of the fins in a packed state, which allows for manual or automatic feedback to the tension subsystem (20) to adjust the average fin height.

12 Claims, 5 Drawing Sheets

84
82
22
92
90
80
78
28

106
94
18
20
40
108
52
48
59
56
32
14

FIN MILL MACHINE

FIELD OF THE INVENTION

The present invention relates to a fin mill machine, and more particularly to a fin mill machine that forms strip stock into corrugated fins to form heat exchanger fins or the like.

BACKGROUND OF THE INVENTION

Conventional serpentine fin machines make strips of fins by infeeding a flat sheet of metallic strip stock and outputting a series of metallic strips having corrugations therein. There are many uses for corrugate fin strips, particularly for vehicle components such as radiator, heater core, evaporator, and condenser fins, among others. The proper fin height is important for these components to allow for proper fin to tube brazing.

The typical fin machine generally works by feeding the continuous length of strip stock between at least one pair of form rollers having interleaved teeth to bend the strip and form corrugations (fins) in the stock. Two significant considerations, as they pertain to the shape of the corrugations, are the average height of the corrugations in a given length of fin stock and the typical variation in fin height from any one given fin to its adjacent fins (fin-to-fin variation). These two considerations are important to optimize the functioning of these fins when installed in the finished assembly.

The average height is generally determined by two main factors. The first factor is the shape of the from rollers and the spacing between the rollers, which determines the coarse average height of the fins. The second factor is the amount of tension imposed on the strip stock as it is fed into the form roller, which determines the fine average height adjustment of the fins.

For these typical machines, periodic samples of the finished fins exiting the fin machine are taken by an operator and measured on a hand device to determine the average height, and this height is compared to the desired nominal height. If the operator determines that the average height is outside of a predetermined limit, he must manually adjust the average tension on the strip stock being fed into the machine and start the hand measuring process over again. This can be particularly difficult given that the adjustment may be in the 1/100's of an inch in height change. If the average height is off, by the time an operator discovers this and corrects it, a significant amount of corrugated fins may be made that must be scrapped. The concern is with measuring and correcting the average height of fin currently coming out of the machine on a continual basis without any substantial time lag for feedback.

In order to more quickly determine the average fin height, attempts have been made to electronically measure the height of the fins as they exit the machine. One such example is disclosed in U.S. Pat. No. 4,753,096 to Wallis ('096). In the '096 patent, an optical sensor, connected to an electronic circuit, is employed along with a measurement shoe, which rests on the finished corrugated fins, to measure the fin height as the fin material exits the machine. However, this measurement has not proven to be accurate enough to properly control the average fin height to within an acceptable range. A problem is that the machine is measuring the fin at the released stage of the operation. In the released state, the fin is generally not stable enough to have a contact measurement taken accurately, i.e., the fin can be compressed by the weight of the device. This is particularly true with thin gauge strip stock and fins that are not formed with tightly packed corrugations.

Furthermore, it is desirable to employ a cheaper sensor than the optical distance sensor that is used in the '096 patent to minimize the contact during measurement, while still maintaining the accuracy required to detect height changes on the order of several ten thousandths of an inch.

Another example of a system, which attempts to measure the average height and provide feedback, is disclosed in Japanese published application 3-243222 ('222). The '222 application employs a shoe which pushes down on the fins with a predetermined amount of force and uses a distance sensor to measure changes in height. However, again the fins can flex during this operation, making accurate measurement still difficult for thin gauge strip stock and fins that are not formed with tightly packed corrugations.

The second significant consideration pertaining to the shape of the fins is the variation in fin-to-fin height, which is generally determined by the consistency of the tension applied to the strip stock as it is fed into the form roller. The more constant the tension, with minimal slight variations in tension, the more consistent the fin-to-fin height. If a problem exists and the desired tension is not held constant, then the fin-to-fin (convolution-to-convolution) height will jump up and down. Moreover, it is desirable to continuously measure the tension in the stock and immediately adjust it as necessary if it varies from the nominal tension desired (i.e., closed loop control).

One system used to maintain the proper tension is a pneumatic cylinder assembly which pinches the strip stock between a pair of cardboard pads to allow the fictional drag to create the tension. A fin machine employing a pneumatic cylinder is disclosed in U.S. Pat. No. 3,367,161. That machine employs a manually controlled pneumatic cylinder along with other sets of spring loaded pressure pads to control tension. However, it provides no automatic feedback, nor continuous monitoring of the actual tension in the stock. Current and past technology employing the pneumatic cylinder for tension has had no closed loop system for adjusting the cylinder pressure, particularly one that is capable of adjusting the required air pressure at the diminutive increments that are necessary in producing consistent corrugated fin heights. For example, a one inch wide strip of aluminum strip stock that is 0.003 inches thick may require only four pounds of tension, and adjustments in cylinder pressure need to be on the order of tenths of a pound. In fact, the '096 patent and Japanese published application 63-101028 ('028) teach that pneumatic cylinders are not adequate for this job, and disclose employing an electronic control clutch brake to maintain the tension.

In order to allow for closed loop control, these systems have moved away from the use of a pneumatic cylinder and the tension control is handled by the electronic control, such as a solenoid controlled braking roller as disclosed in the '028 application or a magnetic particle clutch brake as disclosed in the '096 patent. However, for these configurations, difficulties arise not only in the minimum size material that generally can be handled, but by the many points at which tolerances and wear can creep into the system and affect the fin-to-fin height consistency. Having many locations of potential problems makes trouble shooting a machine difficult and time consuming.

While both electronic brakes allow for closed loop control, one of the concerns associated with employing these electronic types of clutch brakes is that they generally do not maintain consistent enough tension for many fin forming applications. Both require at least two rollers to perform the braking action that creates the tension. Tension fluctuations, then, can be created by such things as non-concentric clutch rollers (out-of-round) and by wear on the bearings that mount these rollers, surface wear on the rollers themselves, and inconsistencies within the clutch itself such as inconsistencies in the clutch bearings. These are relatively expensive parts to repair or replace.

Additionally, the '096 patent design tends to require a complicated electronic set up to regulate it, having many parts that can fail or be out of tolerance. A magnetic particle clutch arrangement also is relatively expensive just with the cost of the clutch itself, the big roller cylinders and the associated, relatively complicated electronic circuitry.

Also, generally the minimum thickness of aluminum material that a magnetic particle clutch, large enough to operate continuously, can effectively handle for a nominal one inch wide strip is about 0.004"–0.005" since there is so much built in resistance to the clutch/roller configuration. The minimum tension which the clutch will allow even if the clutch is shut off can be too great for thinner aluminum strip stock such as 0.003" thick. This is a disadvantage because thinner material, when used in applications such as vehicle condensers, allows for less weight on the vehicle and lower material costs.

Thus, it is desirable to have a fin forming machine which allows for accurate and easily adjustable average fine height adjustment and also maintains consistent fin-to-fin height with minimal variation, while minimizing the cost and complexity of the system.

SUMMARY OF THE INVENTION

In its embodiments, the present invention contemplates a fin mill machine for forming strip stock into corrugated fin material. The fin mill machine comprises a pneumatic cylinder and friction material for receiving the strip stock and applying pressure thereto, tension measurement means for measuring the tension in the strip stock after it passes through the pneumatic cylinder, and tension feedback means for adjusting the pressure in the pneumatic cylinder based on the tension as measured by the tension measurement means. The fin mill machine further comprises forming means for forming corrugations in the strip stock, a first packing station adjacent to the forming means for causing the corrugations to become packed together, and height measurement means for measuring the height of the corrugations between the forming means and the packing station.

Accordingly, an object of the present invention is to provide a fin mill machine for forming corrugations (fins) in continuous length strip stock that will allow for accurate continuous average height measurement and feedback, and will also allow for a consistent tension in the stock to minimize fin-to-fin variation while allowing for continuous feed back and correction of the tension.

An advantage of the present invention is that the average fin height is continuously monitored during forming and can be accurately corrected to the desired average height to minimize scrappage of finished strips of fins.

A further advantage of the present invention is that the tension on the strip stock prior to being fed into the forming stations is maintained at a consistent desired tension with feedback to adjust for any variance therefrom.

An additional advantage of the present invention is that the tension control can be accomplished through two different feedback loops, allowing for automatic feedback based on tension measurements or air pressure based feedback for set-up and trouble shooting conditions.

DETAILED DESCRIPTION OF THE PREFERRED EMBODIMENTS

Figure 1:
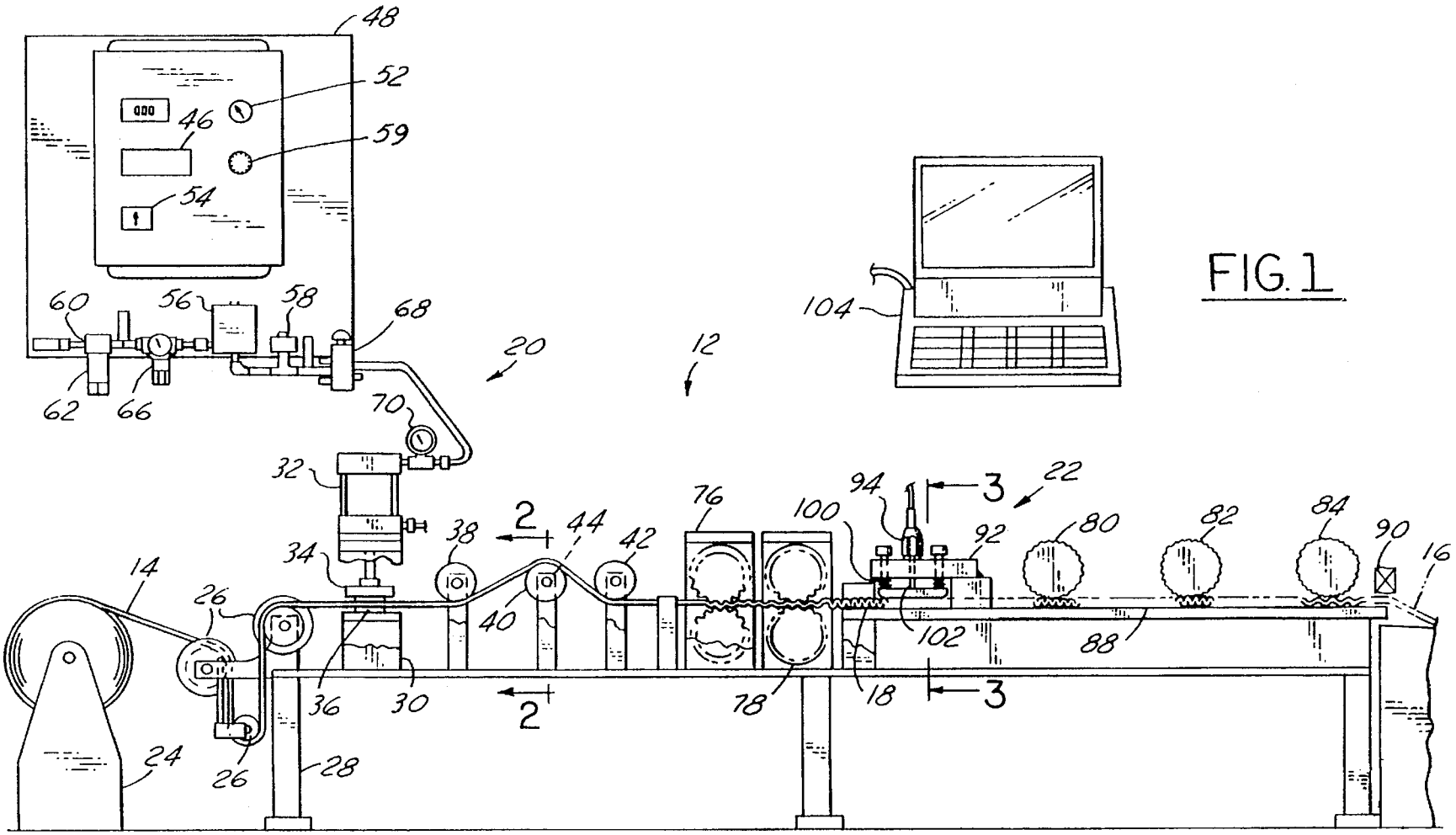
FIG. 1 is a schematic side view of a fin machine according to the present invention.
Figure 2:
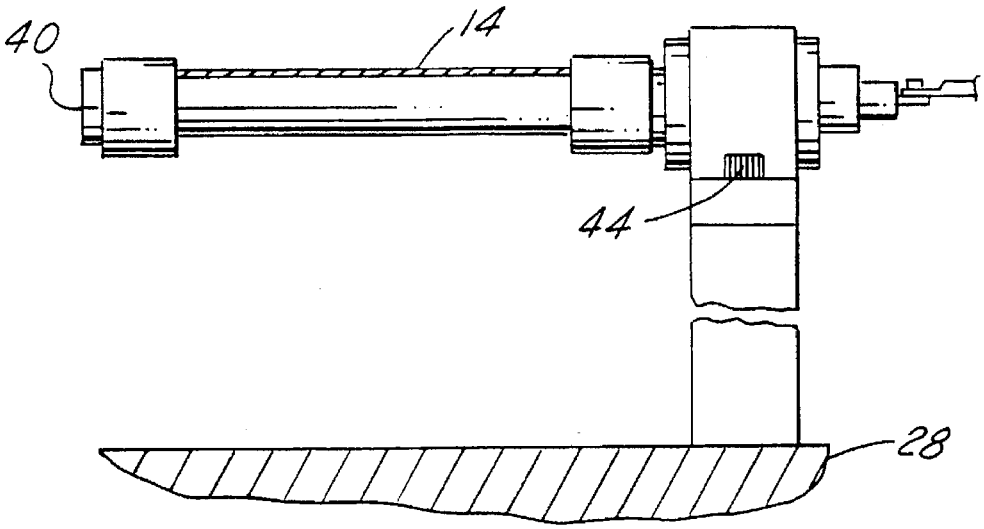
FIG. 2 is a view, on an enlarged scale, of a roller incorporating a strain gauge taken along line 2—2 in FIG. 1.
Figure 3:
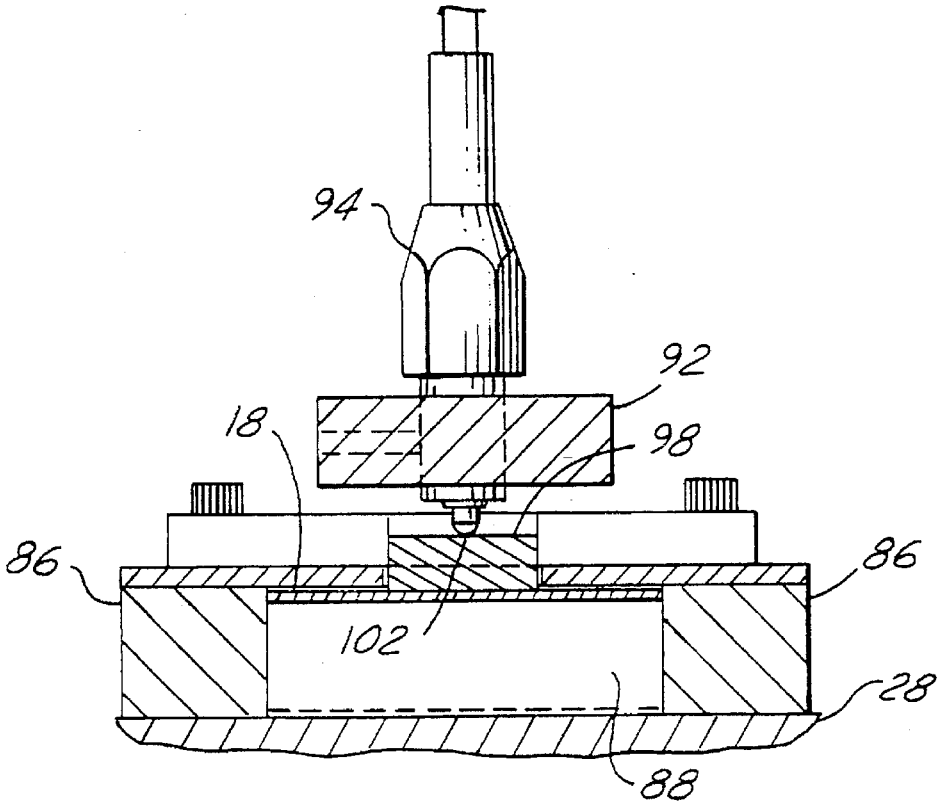
FIG. 3 is a view, on an enlarged scale, of a fin height measurement subsystem taken along line 3—3 in FIG. 1.
Figure 4:
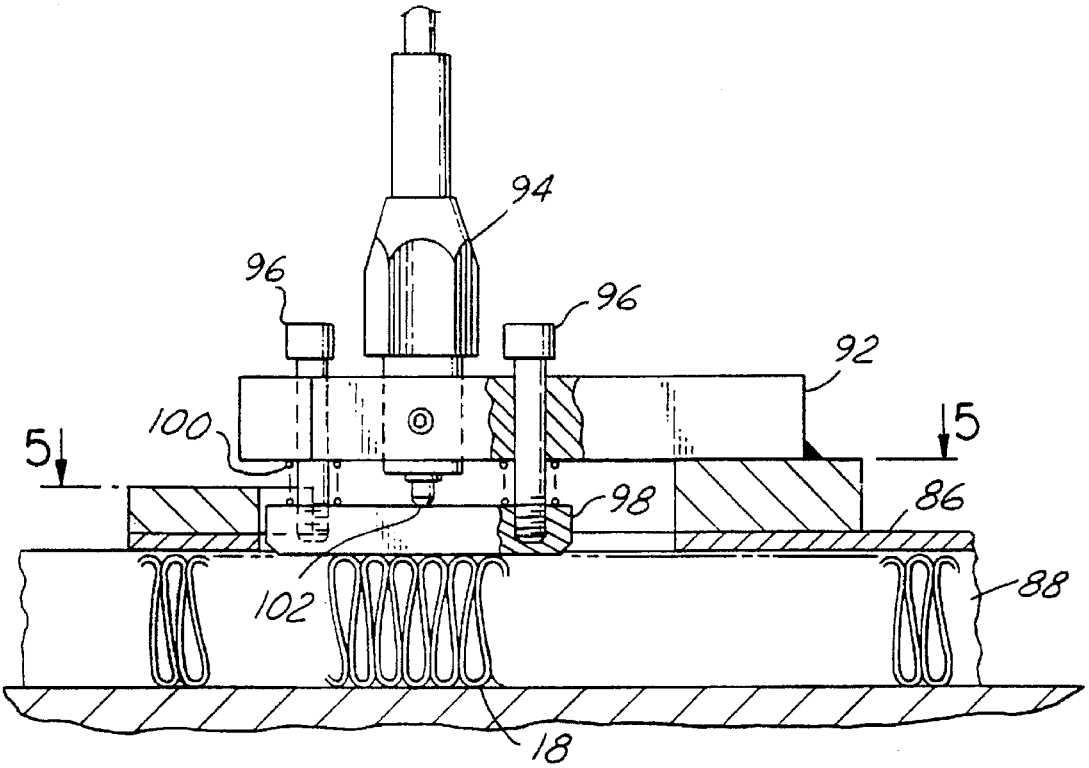
FIG. 4 is a side view, on an enlarged scale, of the fin height measurement subsystem with the fin guards not shown.
Figure 5:
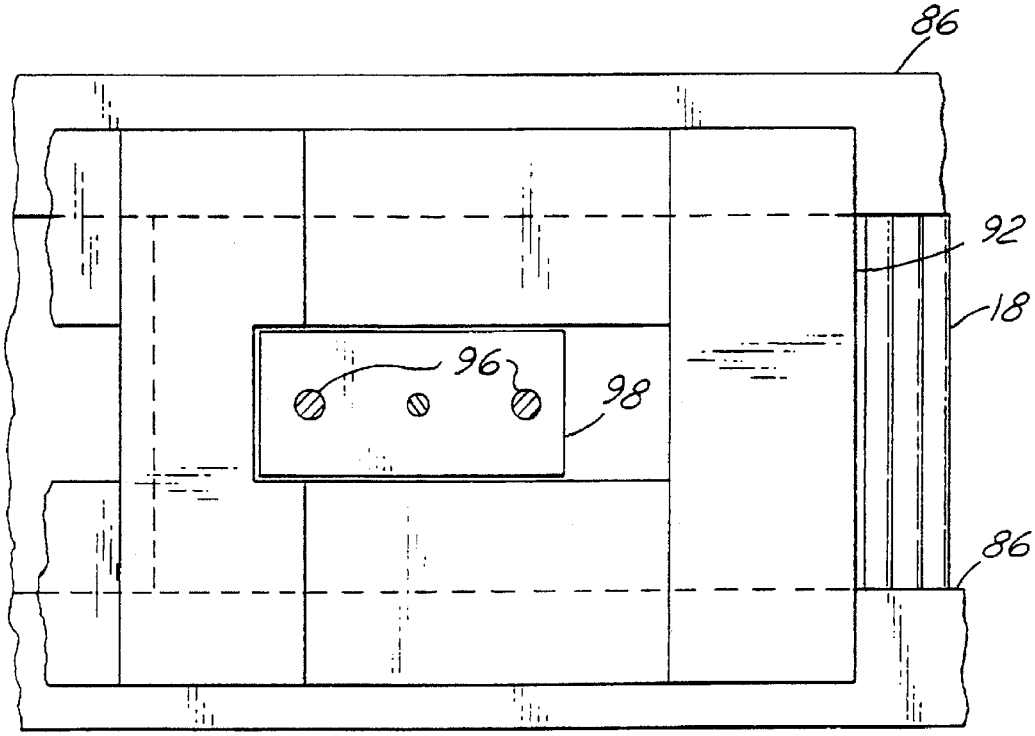
FIG. 5 is a view taken along line 5—5 in FIG. 4.
Figure 6:
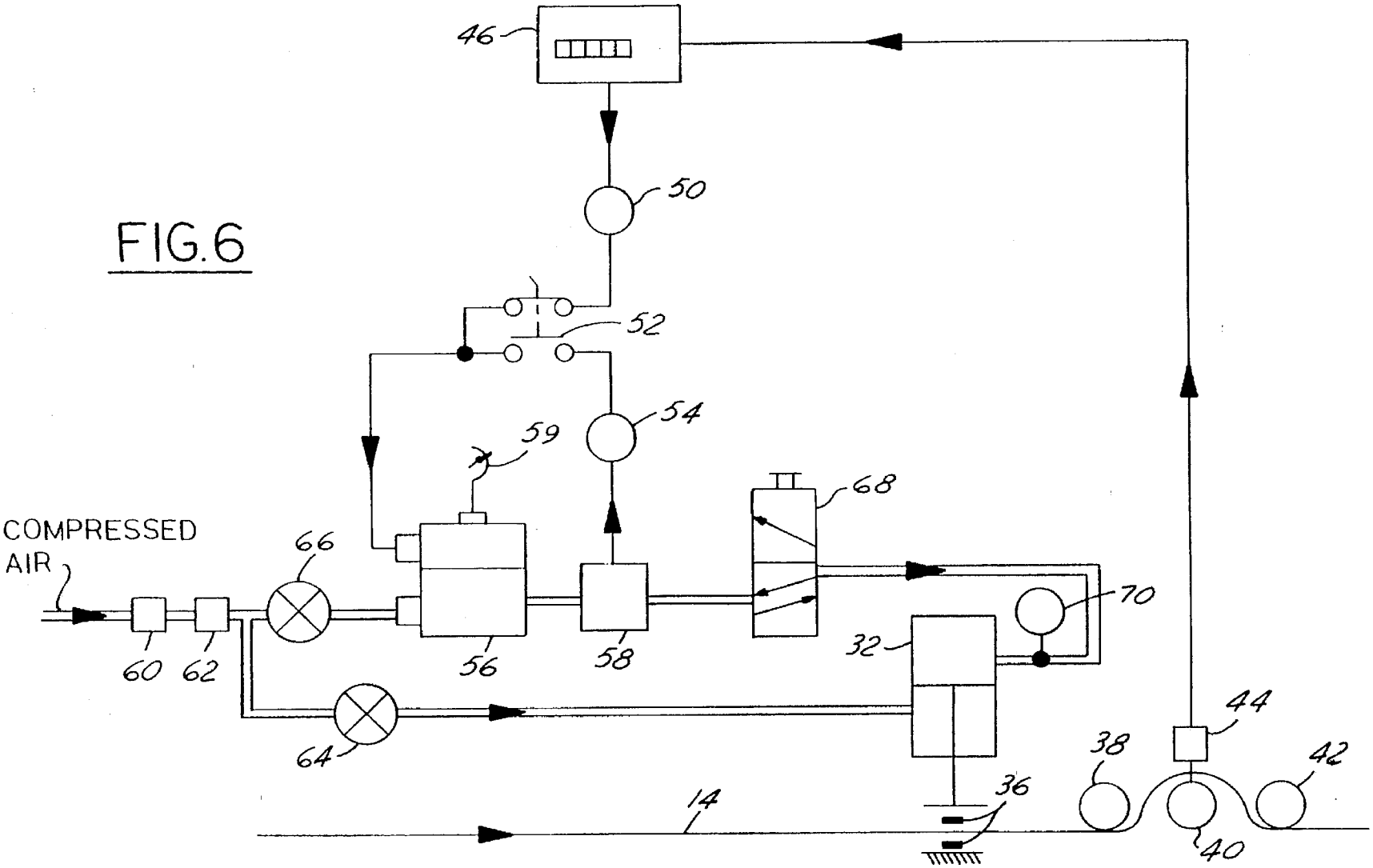
FIG. 6 is a schematic view of the tension and feedback system in accordance with the present invention.

A fin mill machine 12 illustrated in FIGS. 1–6 is employed for pulling flat strip stock 14 into it and producing finished fin strips 16 having precisely formed corrugations (fins) 18 therein. Of particular significance to assure an accurately finished product are the consistency of height from corrugation-to-corrugation (fin-to-fin), which is determined by the tension control subsystem 20 and an accurate and continuous measurement of the average height of the heat exchanger fins, which is determined by the height measurement subsystem 22.

The flat strip stock 14 is secured to a base 24 and fed through three guide rollers 26 before feeding into the tension control subsystem 20, which is mounted to a fin machine base 28. The tension control subsystem 20 includes a mounting block 30 mounted to the fin machine base 28 aligned with a pneumatic cylinder 32 having a plunger 34 protruding therefrom toward the mounting block 30. Two pieces of frictional material 36, such as cardboard or felt pads, surround the strip stock 14 as it extends between the mounting block 30 and plunger 34. One piece 36 is mounted on the block 30 and the other piece 36 is mounted on the plunger 34. The friction pads 36 are inexpensive, and easy to routinely replace, thus minimizing maintenance costs.

The strip stock next threads through three rollers 38, 40 and 42, with the middle roller 40 having a material strain gauge 44 mounted therein. The strain gauge 44 is electrically connected to a signal conditioner and strain gauge indicator controller 46 mounted in a tension control cabinet 48. The indicator controller 46 is electrically connected to a volt meter 50 for strain gauge output. This meter 50 reflects the feedback signal to a proportional valve 56. It is electrically connected to a feedback control switch 52. Also electrically connected to this switch 52 is a meter 54 indicating pneumatic cylinder pressure directly, and the proportional valve 56 is electrically connected to the output of this switch 52. A tension pot 59 sets the proportional valve 56 to the nominal desired pressure.

Thus, there are two feedback loops. This switch 52 in a first position, then, allows for feedback control to the proportional valve 56 directly from the strain gauge 44 through the volt meter 50 based on the tension in the strip 14. The switch 52 in a second position allows for feedback control of the air pressure in the pneumatic cylinder 32 by the meter 54 via a pressure transducer 58 that is electrically connected to the meter 54 and connected to the output of air pressure from the proportional valve 56.

Generally, the switch 52 would be placed in the first position for automatic closed loop feedback control based directly on the tension measured in the strip stock 14. The second position, employing feedback based on air pressure, is available to be used for more of a manual feedback control, with an indirect indication of the tension in the strip stock 14. In this way, during set-up or trouble shooting of the machine, or if the strain gauge should need servicing, the overall fin machine 12 can still be operated, thus, reducing down time of the machine.

The air pressure circuit begins with compressed air fed in from a conventional source, not shown, in a manufacturing plant that produces pressurized air for the operation of pneumatic tools. The compressed air flows through a 5μfilter 60 and then a coalescent filter 62. The pressurized air then branches off, one branch leading to the pneumatic cylinder 32 through a low pressure regulator 64, used for applying a pressure in the lower portion of the cylinder to raise the plunger 34, and the other branch leads to the proportional valve 56 through a relatively higher pressure regulator 66. If so desired, a servo-valve, not shown, could be used instead of the proportional valve 56, eliminating the need for the low pressure regulator 64. Beyond the pressure transducer 58 is a manual override valve 68, which allows the pneumatic cylinder 32 to be raised manually, should the need arise, and a pressure gauge 70 for displaying the current pressure in the cylinder.

Beyond the tension control subsystem 20, a conventional star wheel forming station 76 and a form roller 78 are mounted to the fin machine base 28, which form the corrugations 18 in the strip stock 14. Packing stations 80, 82 and 84 are mounted on the machine base 28 downstream of the form roller 78, which limit the forward movement of the newly formed corrugations 18, thus packing the corrugations tightly together. The strip stock 14 extends through the forming station 76 and the form roller 78 and is received between a pair of fin guards 86, which form a passage tunnel 88 that retains and guides the packed fins in the machine. The fin guards 86 are mounted to the fin machine base 28. Beyond the third packing station 84, a conventional cutting mechanism 90 is employed to cut the fin strips to the proper length before the finished fins 16 leave the machine.

Mounted between the form roller 78 and the first packing station 80 is the height measurement subsystem 22. It includes a base 92, mounted to the fin guards 86, with the base 92 having three holes therethrough. A sensor 94 is secured in and protrudes through one of the holes. A pair of alignment pins 96 slide through the other two holes on either side of the sensor 94 and are affixed to a ski pad 98, which rests on the packed fins between the fin guards 86. A pair of gauge springs 100 are mounted on the pins 96 between the ski pad 98 and the base 92 and bias the ski pad 98 downward onto the packed fins. The sensor 94 includes a head 102 that telescopes out from the sensor until it is in surface contact with the ski pad 98.

The sensor 94 is electronically connected to an averaging amplifier and display 104. The sensor head 102 itself is a spring loaded device, although it could be weighted instead of spring loaded. Either a spring or a weight can be used because the fins 18 are packed and increased spring load or weight will not squash or misshape the fins 18. This allows for the contact of sensor head 102, with no need for an optical sensor and a gap, making the sensor cheaper than an optical gauge, although an optical sensor can be used if so desired.

Before initially operating the machine, the strain gauge 44 is calibrated to determine a correspondence between the tension in the strip stock 14 and the measured value of the strain gauge 44. The calibration test consists of hanging a known accurate weight from the strip stock 14 upstream of the pneumatic cylinder 32, and reading the value of the strain gauge 44, then the strain gauge 44 is adjusted to read the known actual weight.

In operation, as the stock 14 is fed through the tension control subsystem 20, the air cylinder 32 is used to apply drag, via the friction pads 36, creating a tension in the stock 14. The amount of material strip tension determines the fine adjustment of fin height.

An operator uses a command signal to set the desired material tension via the proportional valve 56 and cylinder 32. The proportional air servo valve 56 determines the amount of pressure applied by the pneumatic cylinder 32. As the strip stock 14 is fed through the machine, strain gauge indicator controller 46 receives a feedback signal from the material tension strain gauge transducer 44. The controller 46 compares the measured tension to the desired tension and adjusts the servo valve 56 accordingly. Thus, using the closed loop feedback from the material strain gauge 44, the air cylinder 32 is able to maintain very constant material strip tension.

If one desired to operate the pneumatic cylinder 32 manually rather than based on the strain gauge reading, then switch 52 can be moved and the pressure controlled by meter 54 based on pressure readings from transducer 58.

After the strain gauge rollers 38, 40 and 42, the strip 14 is fed through the star wheel forming station 76 and the form rollers 78 that cut and form the part into corrugations. The first packing station 80 rotates at a slower rate than the form rollers 78, causing the fins 18 to become packed tightly together.

The sensor head 102 rides continuously on the ski pad 98 that is in direct contact with the fins 18 in the packed state as they flow through the machine. The ski pad 98 is used for two reasons, the first is to hold the fins 18 down to the bottom of the passage tunnel 88 for a stable, accurate reading; the second reason for the ski pad 98 is to cover a wider area that the sensor head 102 alone would cover.

The sensor continuously measures the fin height at the density station while the fins 18 are moving through the machine. The key here is that the measurement is taken when the fins are in a packed formation as opposed to an unpacked formation as generated at the output of the machine, where the fins are more unstable and thus more difficult to accurately measure on a continuous basis. The packed state allows more force to be used on the fins to hold them down, and get a more consistent reading.

The changes in height measured at the height measurement subsystem 22 when the tension is changed is near equivalent to the change in fin height in the unpacked finished state for small adjustments in height. Also, although the fin height at the density station is not equal to the final output part height there is a correlation between the height at the density stations and height of the finished parts when unpacked. The fin height difference between the measuring location and the final output part are directly related and can be determined during machine set-up.

This measured height value can then be sent to the averaging amplifier and display 104 for operator control, accounting for the ratio of height in the packed and finished state by creating a deviation value, to manually adjust the tension in the strip stock 14 by adjusting the pressure in the pneumatic cylinder 32, to correct the average fin height. Generally, the system preferably employs an averaging of the continuous height measurement over a predetermined time interval to determine the height measurement used for the correction. Specification of both the time period for measurement and the number of samples per value can be specified by inputting them into the averaging amplifier 104.

Once formed, a count roller, not shown, tracks the correct number of corrugations and holds the fins while the cutting mechanism 90 cuts the finished parts 16 to the required length. The finished part 16 is held to a specific output density requirement (convolutions per inch or more frequently termed as fins per decimeter). Due to the springback of the material, the cutter is required to pack the fin tightly so that when it is released, it maintains the correct density.

Figures 7, 8:
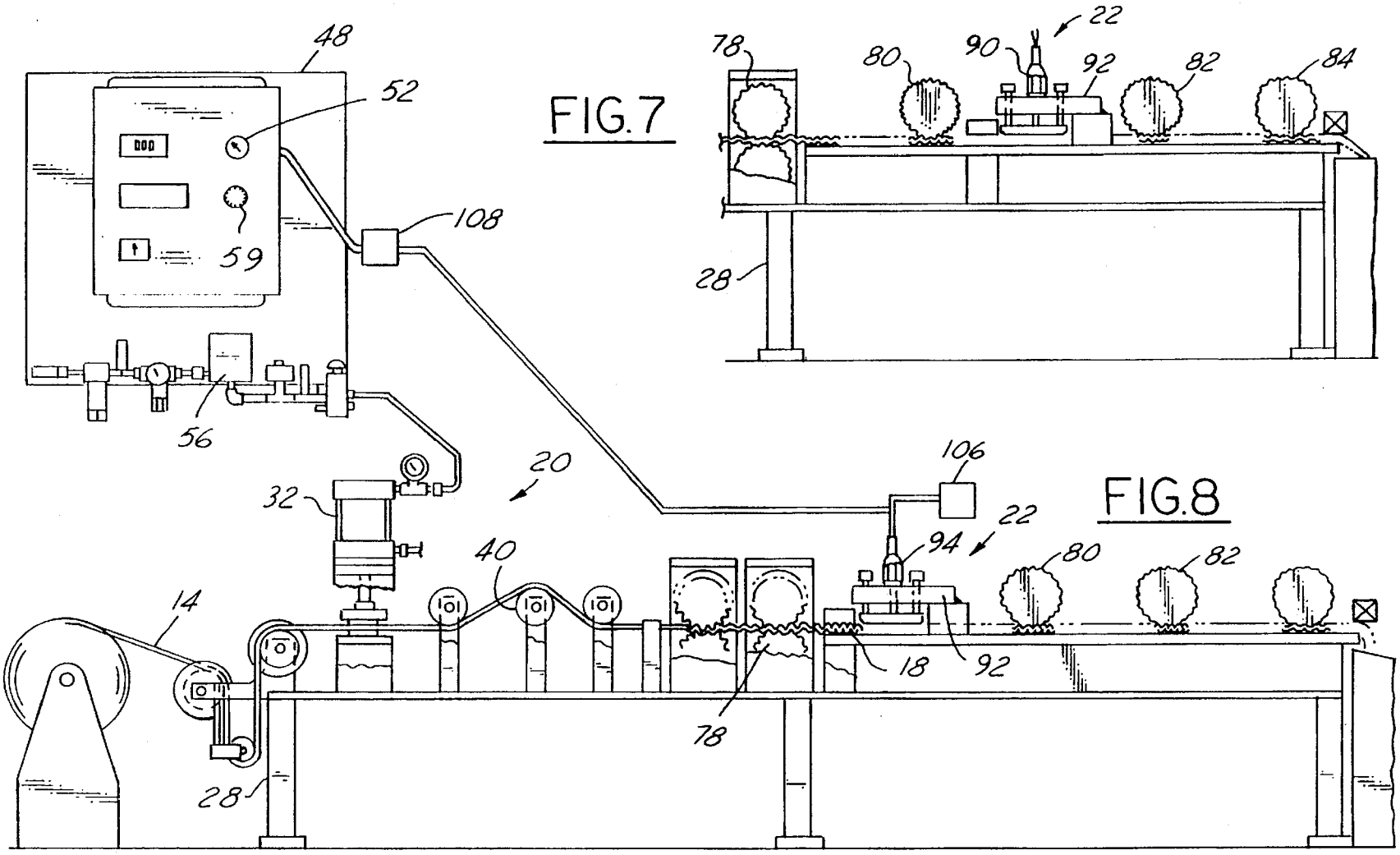
FIG. 7 is a schematic view of an alternate embodiment illustrating a portion of the fin mill machine in accordance with the present invention.
FIG. 8 is a schematic view of a second alternate embodiment illustrating a portion of the fin mill machine in accordance with the present invention.

A first alternate embodiment is shown in FIG. 7. In this embodiment, the fin mill machine is essentially unchanged, except for the location of the height measurement subsystem 22'. The subsystem 22' is mounted between the first packing station 80 and the second packing station 82. Since the fins are also in a packed state at this location, the height can again be accurately measured.

A second alternate embodiment is shown in FIG. 8. In this embodiment, the height averaging amplifier and display is eliminated and an averaging amplifier and comparator 108 are connected to the sensor 94 and incorporated into the tension control circuit, creating a direct feedback loop that adjusts the desired tension for the strip stock based on the fin height measurement. Thus, making it an automatic continuous fin height correction device rather than just an automatic fin height monitoring device.

The height measurement signal can further be sent to a conventional digital computer 106 to directly compute conventional quality charts used in manufacturing facilities which calculate and plot statistical values such as X-BAR and R charts, (X-Bar being the average of the read averages for a given interval, and R being the range of those values, the difference between the highest and lowest value, within that given interval over which X-Bar is calculated). These can be sent to a conventional printer, not shown, for plotting to allow for monitoring of machine performance for maintenance and repairs.

While certain embodiments of the present invention have been described in detail, those familiar with the art to which this invention relates will recognize various alternative designs and embodiments for practicing the invention as defined by the following claims.

We claim:

1. A fin mill machine for forming strip stock into corrugated fin material comprising:

a pneumatic cylinder and friction material for receiving the strip stock and applying pressure thereto;

tension measurement means for measuring the tension in the strip stock after it passes through the pneumatic cylinder;

tension feedback means for adjusting the pressure in the pneumatic cylinder based on the tension as measured by the tension measurement means;

forming means for forming corrugations in the strip stock;

a first packing station adjacent to the forming means for causing the corrugations to become packed together between the forming means and the first packing station; and height measurement means for measuring the height of the corrugations between the forming means and the packing station.

2. The fin mill machine of claim 1 wherein the tension measurement means includes three rollers through which the strip stock is fed, with one of the rollers including a strain gauge which is electrically connected to the tension feedback means.

3. The fin mill machine of claim 2 wherein the tension feedback means includes means for receiving a signal from the strain gauge, controller means for receiving an input of the desired tension and comparing it to the signal from the strain gauge, and valve means, electrically connected to the means for receiving a signal, for adjusting the pressure applied to the strip stock by the pneumatic cylinder based on the comparison.

4. The fin mill machine of claim 3 wherein the tension feedback means further includes a pressure transducer adapted to be manually adjustable and electrically connected to the valve means, and switch means for selectively switching the electrical connection to the valve means between the controller means and the pressure transducer.

5. The fin mill machine of claim 1 wherein the tension feedback means further includes a pressure transducer adapted to be manually adjustable, and switch means for selectively switching the tension feedback between the tension measurement means and the pressure transducer.

6. The fin mill machine of claim 1 wherein the height measurement means further includes means for calculating an average height over a predetermined interval and means for displaying the average height.

7. The fin mill machine of claim 1 further including height measurement feedback means for receiving a desired height measurement input and adjusting the tension in the pneumatic cylinder based on a comparison with the measured height of the corrugations.

8. The fin mill machine of claim 1 wherein the height measurement means comprises a ski pad resting on the corrugations as they are packed together, a base mounted in a fixed relationship to the packing station above the ski pad, a sensor, having a head, mounted to the base, with the head in surface contact with the ski pad, guide means for telescopically mounting the ski pad relative to the base, and biasing means for biasing the ski pad away from the base and toward the corrugations.

9. A fin mill machine for forming strip stock into finished fins comprising:

a pneumatic cylinder and friction material for receiving the strip stock and applying pressure thereto;

tension measurement means for measuring the tension in the strip stock after it passes through the pneumatic cylinder;

first tension feedback means for adjusting the pressure in the pneumatic cylinder based on the tension as measured by the tension measurement means;

second tension feedback means adapted for manual adjustment of the pneumatic cylinder pressure;

switch means for selectively switching the feedback between the first tension feedback means and the second tension feedback means;

forming means for forming corrugations in the strip stock;

a first packing station adjacent to the forming means for causing the corrugations to become packed together between the forming means and the first packing station; and height measurement means for measuring the height of the corrugations between the forming means and the packing station.

10. The fin mill machine of claim 9 wherein the tension measurement means includes three rollers through which the strip stock is fed, with one of the rollers including a strain gauge which is electrically connected to the first tension feedback means.

11. A fin mill machine for forming strip stock into finished fins comprising:

a pneumatic cylinder and friction material for receiving the strip stock and applying pressure thereto;

tension measurement means for measuring the tension in the strip stock after it passes through the pneumatic cylinder;

tension feedback means for adjusting the pressure in the pneumatic cylinder based on the tension as measured by the tension measurement means;

forming means for forming corrugations in the strip stock;

a first packing station adjacent to the forming means for causing the corrugations to become packed together between the forming means and the first packing station;

height measurement means for measuring the height of the corrugations between the forming means and the packing station; and height measurement feedback means for receiving a desired height measurement input and adjusting the tension in the pneumatic cylinder based on a comparison with the measured height of the corrugations for the height measurement means.

12. The fin mill machine of claim 11 wherein the height measurement means further includes means for calculating an average height over a predetermined interval and means for displaying the average height.

* * * * *